US005797424A

United States Patent [19]

Tisbo et al.

[11] Patent Number: 5,797,424

[45] Date of Patent: Aug. 25, 1998

[54] HOSE REEL

[75] Inventors: Thomas A. Tisbo, Barrington Hills; Stephen P. Whitehead, Elgin; Brian Moon, Sycamore, all of Ill.

[73] Assignee: Suncast Corporation, Batavia, Ill.

[21] Appl. No.: 808,878

[22] Filed: Feb. 28, 1997

Related U.S. Application Data

[63] Continuation of Ser. No. 514,471, Aug. 11, 1995.

[51] Int. Cl.[6] ..... B65H 75/34

[52] U.S. Cl. ..... 137/355.27; 137/315; 137/580

[58] Field of Search ..... 137/355.26, 355.27, 137/580, 315

[56] References Cited

U.S. PATENT DOCUMENTS

| | | | |
|---|---|---|---|
| 4,506,698 | 3/1985 | Garcia et al. | 137/355.26 |
| 4,512,361 | 4/1985 | Tisbo et al. | 137/580 |
| 4,768,546 | 9/1988 | Brusadin et al. | 137/355.27 |
| 5,425,391 | 6/1995 | Tisbo et al. | 137/355.27 |
| 5,657,789 | 8/1997 | Tisbo et al. | 137/580 |

*Primary Examiner*—A. Michael Chambers
*Attorney, Agent, or Firm*—McHale & Slavin

[57] ABSTRACT

The instant invention is an improvement to the hub connections of a hose cart by providing a syringe type hub attachment which allows for and maintenance of water seals without tools. In addition, hub design allows for the placement of a crank for rotating of the hose reel flange in either a left hand or right position with the water coupling portion exchangeable by quick release of the syringe type hub attachment.

3 Claims, 3 Drawing Sheets

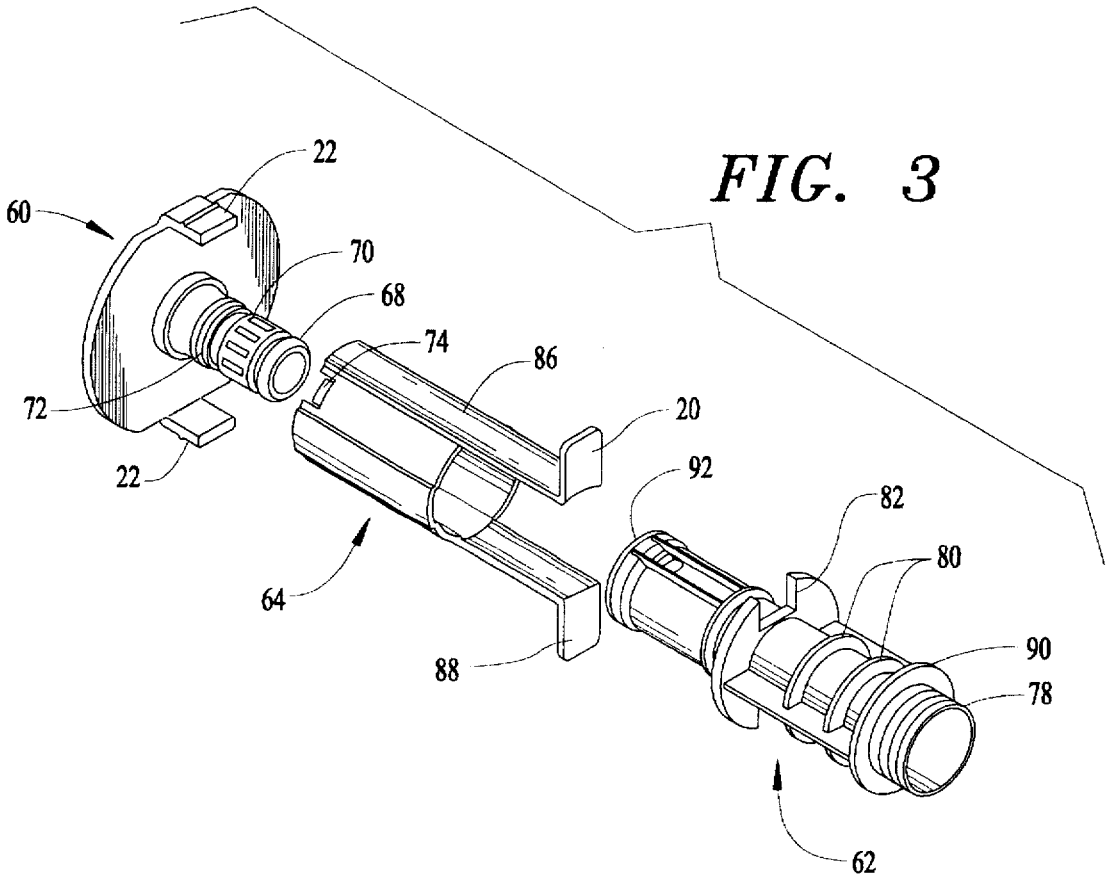
FIG. 3
FIG. 4
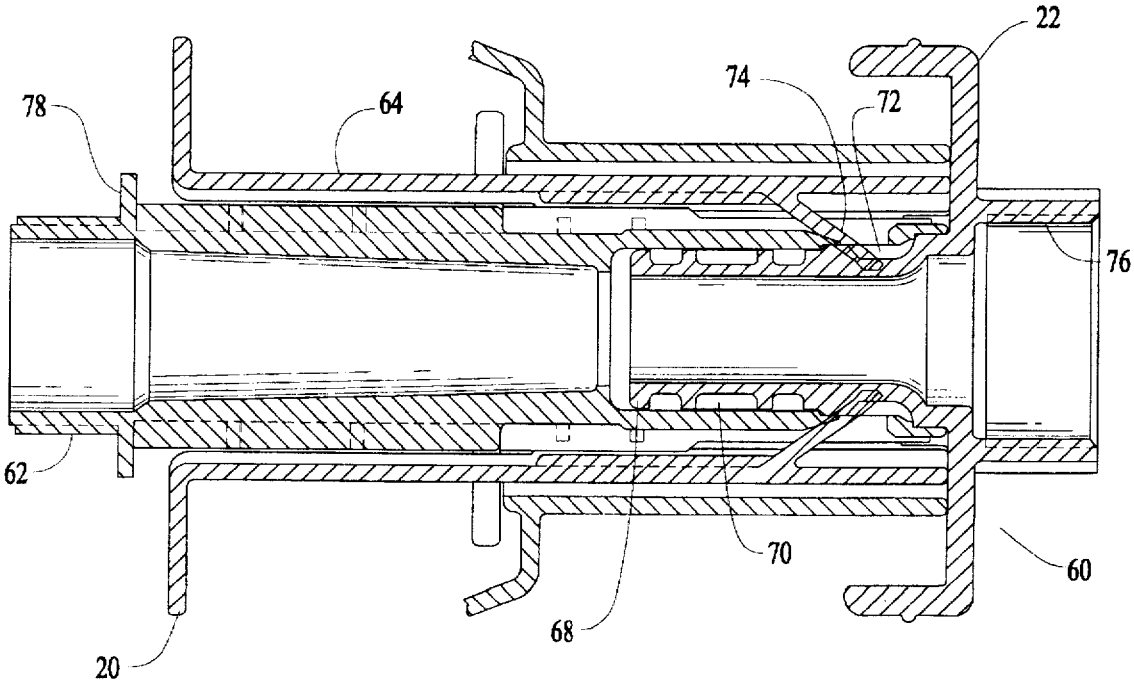

HOSE REEL

This application is a continuation of copending application Ser. No. 08/514,471 filed on Aug. 11, 1995.

FIELD OF THE INVENTION

The instant invention is related to hose reels and in particular to an improvement in spool attachment and cranking.

BACKGROUND INFORMATION

Portable hose carts for convenient handling and storage of flexible garden hoses have gained wide public acceptance. Such carts are primarily constructed of molded plastic components having a centrally disposed rotatable spool for reeling inward or outward the flexible hose, a frame including a pair of frame sides for supporting the spool, wheels at one end of the base of the frame, and a handle for tilting the frame onto the wheel so that the cart may be easily moved.

Hose carts are commonly purchased by the general consumer wherein it is desirable that the hose cart can be easily assembled with minimal use of hand tools. Commercially available hose carts typically make extensive use of threaded fasteners to join major components. The use of such fasteners can be time consuming and requires the use of hand tools. U.S. Pat. No. 4,913,580 teaches the use of a connector assembly for joining components of a hose cart. A male component of the assembly is molded with one piece of the cart, and a female component of the assembly is molded with a second piece of the cart to be joined to the first piece. These components are easily unlatched to permit disassembly of the hose cart.

A problem with portable hose carts of the prior art is that, despite the directions for assembly, a majority of the consuming public is unable or have no desire to assemble such devices. Cottage industries have developed solely for the purpose of assembling products that have been purchased in a disassembled state. Many stores that inventory unassembled product have personnel on duty capable of assembling the product for the customer. If the store performs this assembly at no charge to the customer, it is both a time and resource burden on the store. Realistically, the store must assemble the product and pass on the cost to the consumer, thus raising the net cost of the product.

One of the problems with any assembly outside of the factory is that improper assembly can damage the product. This typically occurs when the assembler does not read the instructions or tries to force fit a component. The result is aggravation by the purchaser who may ask the store to take back the product and refund their money. Obtaining a refund is a time consuming and expensive process to both the store and the producing factory. The store may return the product to the factory who then attempts to salvage the damaged product. Not unexpectedly, most returned items are damaged as a result of improper assembly.

Another problem with prior art hose reel devices is in the securement of the reel hub necessary for the introduction of water. The reel hub must allow rotation yet allow the device to be hooked up to a water supply wherein the hose can be reeled inward or outward without interfering with the flow of water. Seals within the hub allow rotation without leakage. The problem occurs when the seal requires service, either in the form of lubrication or replacement. This is a common problem in northern states should the device be allowed to freeze.

U.S. Pat. Nos. 4,512,361 and 5,046,520 set forth hose cart storage apparatuses which consist of various pre-assembled components that are easily assembled upon receipt by the average consumer. As exemplified by the '361 and '520 patents, the hub is coupled to the reel by the use of fasteners such as a metal screw. When the seals require service, the hub must be removed to facilitate replacement. without proper tools, the unit will be damaged. Should the attachment screws be displaced, the use of improperly sized substitutes may cause the screw threads to strip, thereby damaging the unit. The necessity of tools may intimidate the average consumer from performing even routine maintenance such as lubrication, leading to premature failure of the seals.

Thus, what is lacking in the art is a spool attachment to improve the hose reel that can be disassembled without tools and includes a means for reducing stress from a hose wrapped around the reels.

SUMMARY OF THE INVENTION

Among the several aspects and features of the present invention may be noted an improvement in spool attachment by use of a syringe type quick connect element that allows for replacement of and maintenance of O-rings without the need for accessing tools. The flexible hose is wound around the reel by use of a hand crank coupled through a hub providing a direct rotational link between the crank and the winding of the spool. During non-use, a handle on the crank is placed in a storage position by pivoting the handle about one end of the crank so as to place the handle in a position perpendicular to the crank. The crank can be positioned on either side of the frame thus enabling a left or right handed operation. Despite the unit being preassembled by the factory, this interchangeability feature allows a water connector to be easily removed from the hub by depressing a syringe type pulling mechanism surrounding the connector to release tabs biased on the inside of the hub. The quick release water connector provides ease of access to internal sealing O-rings should they need maintenance.

Thus, a primary objective of the instant invention is to disclose the use of quick release locking tabs that allow the crank of a winding spool to be placed on either side of the frame permitting left or right handed operation.

Another objective of the instant invention is to provide a water connector that can be installed and removed without the use of hand tools. In particular, the connector will use a syringe type attachment mechanism that engages tabs on the inner surface of the hub to be disengaged for access to replaceable O-rings.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DESCRIPTION OF THE DRAWINGS

FIG. 3 is an exploded view of the water coupler.

FIG. 4 is a cross sectional side view of an assembled water coupler.

DETAILED DESCRIPTION OF THE PREFERRED EMBODIMENT

Although the invention has been described in terms of a specific embodiment, it will be readily apparent to those skilled in this art that various modifications, rearrangements and substitutions can be made without departing from the spirit of the invention. The scope of the invention is defined by the claims appended hereto. The syringe type water coupler is described with reference in general to FIGS. 1–4.

Figure 1:
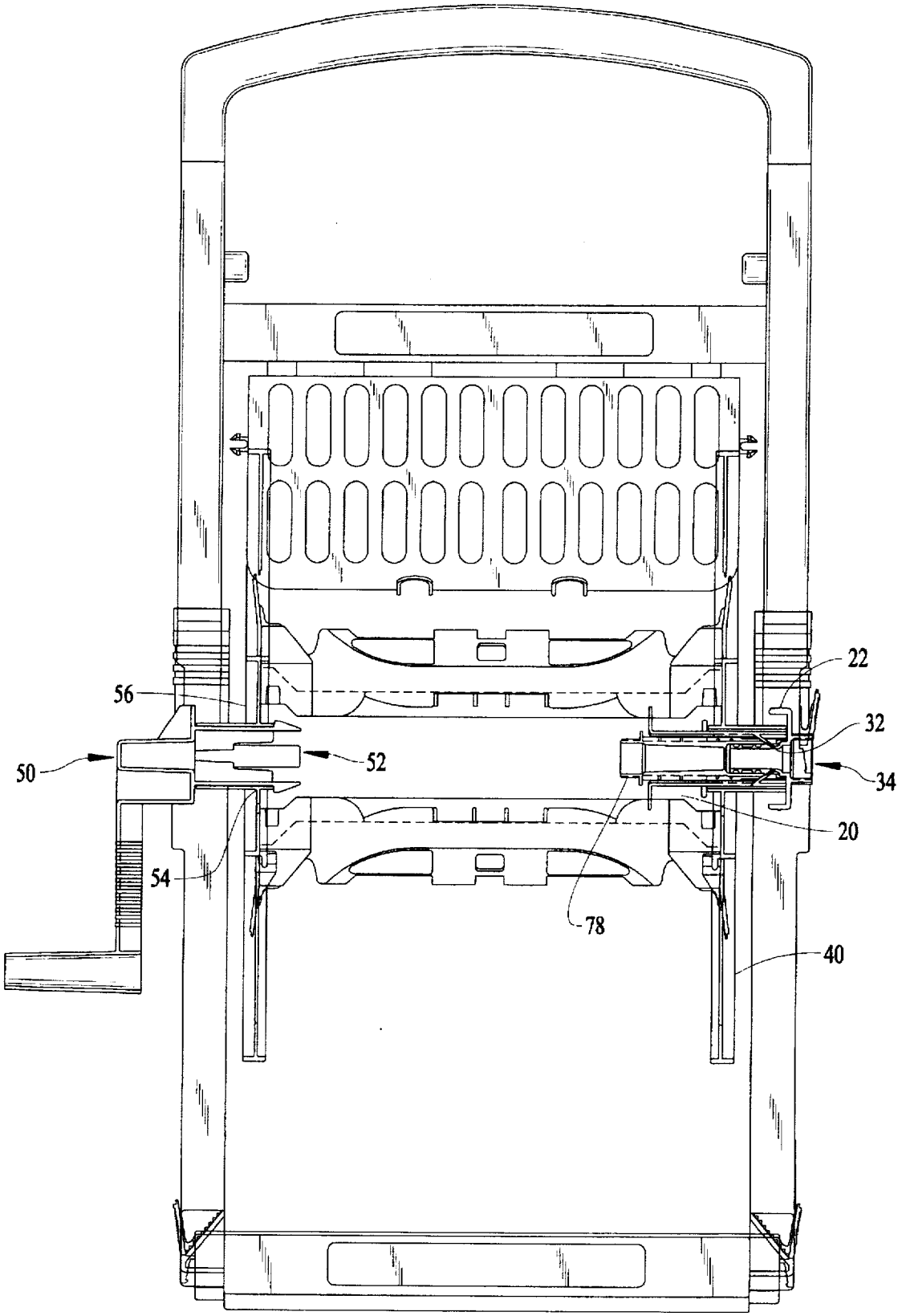
FIG. 1 is a side view of a conventional hose cart having a modified hub aperture for receipt of the syringe type water coupler of the instant invention.
Figure 2:
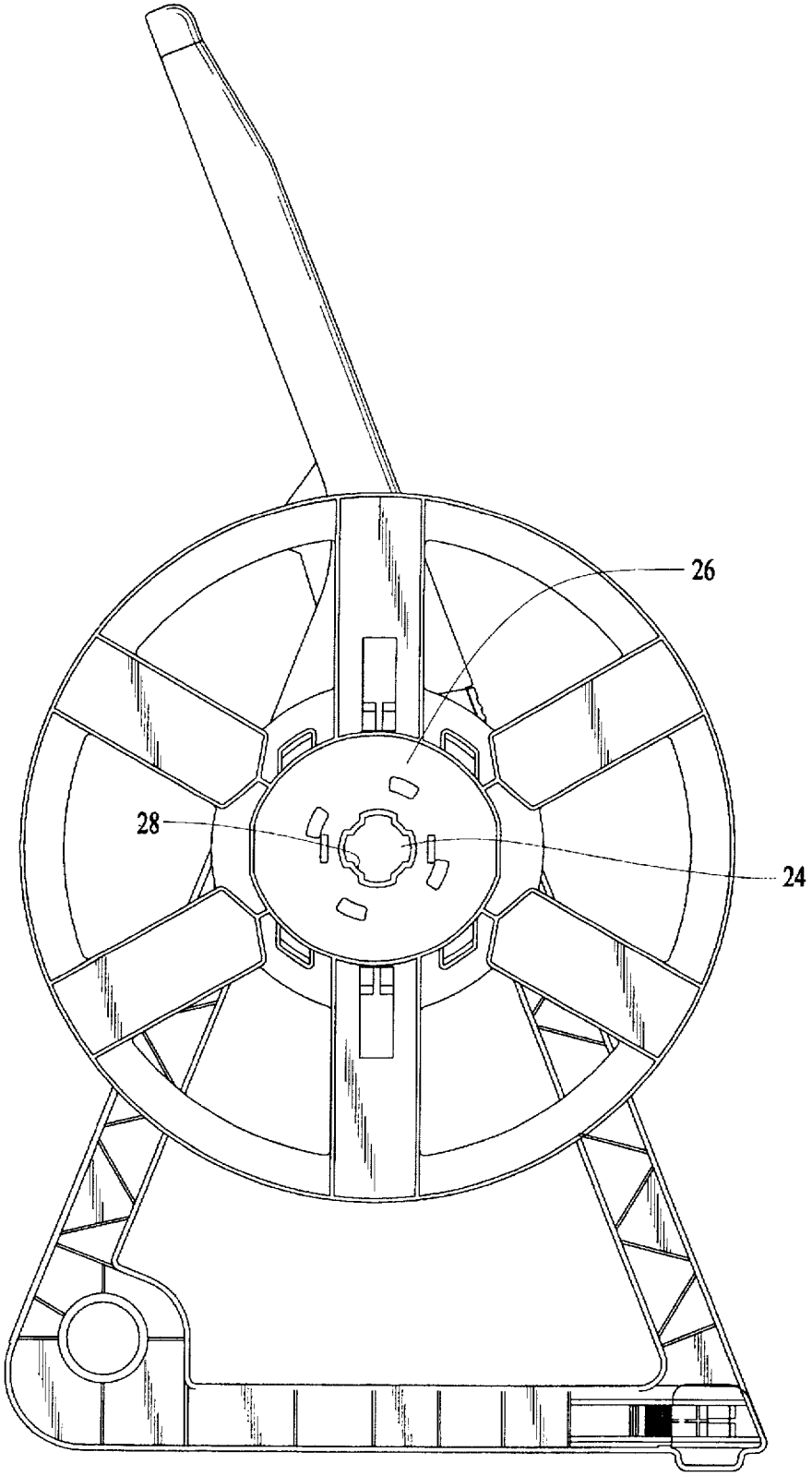
FIG. 2 is a front view with the water hub coupling and hand crank shown in a cross-sectional format.

The hose connector is composed of a hose male coupler 10, a hose female connector 12, and a syringe type coupling sleeve 14 for releasably coupling the hose male coupler 10 to the female connector 12 as best seen in FIGS. 1 and 2. Water from a conventional hose outlet is delivered to the hose female connector 12 having alignment tab 16 for securement to the hub of the reel flange to prevent rotation. The hose female connector 12 includes a molded outlet tube 18 having a plurality of O-rings 20 for engagement with the interior of the hose male connector 10 to form a seal between the coupler 10 and the adaptor 12. A groove 22 is provided for insertion of a plurality of locking tabs 24. The end 26 of the adaptor has internal hose threads formed therein for attachment to the male end of a conventional garden hose. The hose male coupler 10 has an end 28 having external hose threads formed thereon for attachment to the female end of a conventional garden hose, in this instance, to the end of the flexible hose (not shown) for winding about the reel. The hose male coupler 10 is formed of a pipe with reinforcement ribs 30 with an elongated slot 32 located on a lower portion 34 of the coupler insertable through release sleeve 14 formed from a tubular body 36 with the aforementioned locking tabs 24. The sleeve 14 includes finger pulls 36 and 38. The adaptor 12 fits within the coupler 10 so that the seals 20 frictionally engage the inner surface of the coupler 10 forming a water tight seal between the inlet 26 and the outlet 28. The sleeve 14 locks the coupler 10 to the adaptor 12 by insertion of the tabs 24 into groove 22. In operation the pressing of the coupler 10 into the adaptor 12 engages the lock tabs 24 through the hub of the flanges (not shown) of the reel. To release the coupling, the finger tabs 36 and 38 are pulled toward the coupling collar 40 wherein the leading edge 42 of the coupler 10 biases the locking tabs 24 into a raised position so as to disengage the lock from the groove 22 allowing disassembly of the connection. Thus, lubrication or replacement of, the O-rings 20 is readily accessible by pulling the tabs 36 in a syringe type movement. Upon the need for maintenance of the O-rings, the adaptor and coupler can be snapped back into position.

Referring to FIGS. 3 and 4, the syringe type water coupler is composed of a female hose coupler 60, a hose male connector 62, and a syringe type coupling sleeve 64 for releasably securing the hose female coupler 60 to the male connector 62. The female hose coupler 60 includes alignment tabs 22 for securement of the coupler to the hub 26 of the reel flange 40 and a molded outlet tube 68 having a plurality of O-rings 70 for frictionally engaging the interior of the connector 62 forming a leak resistant seal between the coupler 60 and connector 62. Groove 72 engages locking tabs 74 upon insertion, removal of the locking tabs requires pulling on syringe handle 20 causing tabs 74 to bias upward disengaging from the groove 72.

Hose coupler 62 includes end 78 having external hose threads formed thereon for attachment to the female end of a conventional garden hose to be wound about the hose reel. The coupler 62 is formed of a pipe with reinforcement ribs 80 having an elongated slot 82 located on a lower portion of the coupler which allows insertion through release sleeve 64 of syringe handle 20 further defined as finger pulls 86 and 88. The sleeve 64 locks the coupler 60 to the adaptor 62 upon insertion of tabs 74 into groove 72. Thus, the pressing of the coupler 60 into the adaptor 62 engages lock tabs 24 through the hub of the reel flanges.

To release the coupling for servicing of the O-rings, the finger tabs 86 and 88 are pulled toward the coupling collar 90 wherein the leading edge 92 of the coupler 62 biases the locking tabs 74 into a raised position so as to disengage the locking tabs 74 from the groove 72. Lubrication or replacement of the O-rings is then readily accessible and upon completion of the maintenance the adaptor and coupler can be snapped back into position.

The crank 50 includes locking tabs 56 which are biased outward for engagement of the hub utilizing the similar slots as provide by male connector and female coupler. In this manner, the crank can be used on either side of the reel flange allowing the consumer to use the hose reel in a left or right handed manner. As the syringe connector provides for ease of removal without tools, the placement of the handle can be easily and quickly changed.

It is to be understood that while we have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. An improved spool attachment apparatus comprising:

a hose coupler insertable through a first side surface of a hub of a hose reel, said hose coupler forming a flange with a centrally disposed threaded inlet opening and outlet opening, said hose coupler having a flange means with alignment tabs for securing to a first side surface of the hub;

a hose connector having and inlet and an outlet, said inlet forming a receptacle for coupling to said hose coupler, said receptacle extending through said hub with said outlet extending from a second side surface of said hub;

a coupling sleeve secured to said hose connector for releasably securing said hose connector to said hose coupler, said coupling sleeve including a plurality of inwardly biased tabs for securing said hose connector to said hose coupler and a finger actuated pull lever for moving said biased tabs outwardly allowing disengagement of said biased tabs for disengaging said hose connector from said hose coupler;

at least one o-ring secured to said hose coupler for fluidly sealing said hose coupler to said hose connector;

whereby said hub forms a portion of a reel flange providing a fluid coupling between the inlet and outlet during rotation of the reel flange.

2. The apparatus according to claim 1 wherein said finger actuated pull levers further operate as an alignment tab operatively associated with said hub, said hub having a corresponding tab receptacle allowing rotation of said hose connector while said hose coupler remains stationary.

3. The apparatus according to claim 1 wherein including a crank releasably-insertable through one of the hubs of a providing a direct coupling to the spool of a hose reel allowing rotation thereof, said crank including a crank handle positioned perpendicular to the hub for ease of rotation.

* * * * *